US005511835A

United States Patent [19]

Hardee

[11] Patent Number: 5,511,835

[45] Date of Patent: Apr. 30, 1996

[54] LATCH WITH MULTIPLE LOCKING MEANS

[76] Inventor: Carl B. Hardee, 2271 Highway 348, Loris, S.C. 29569

[21] Appl. No.: 31,181

[22] Filed: Mar. 12, 1993

[51] Int. Cl.[6] ..... E05C 3/04

[52] U.S. Cl. ..... 292/238; 292/67; 292/205

[58] Field of Search ..... 292/238, 5, 284, 292/259, DIG. 65, DIG. 44, 302, 327, 328, 218, 300, 67, 205

[56] References Cited

U.S. PATENT DOCUMENTS

| | | | |
|---|---|---|---|
| 565,847 | 8/1896 | Edwards | 292/DIG. 44 X |
| 1,284,399 | 11/1918 | McManus | 292/67 X |
| 1,846,318 | 2/1932 | Dickey | 292/5 |
| 1,894,913 | 1/1933 | Sadler | 292/238 X |
| 2,776,855 | 1/1957 | Nystrom | 292/284 |
| 2,794,663 | 6/1957 | Grodt et al. | 292/205 X |
| 2,968,506 | 1/1961 | Lade | 292/DIG. 65 X |
| 4,062,575 | 12/1977 | Robins | 292/67 |

FOREIGN PATENT DOCUMENTS

| | | | |
|---|---|---|---|
| 738867 | 10/1932 | France | 292/259 |

*Primary Examiner*—Rodney M. Lindsey
*Attorney, Agent, or Firm*—W. Alex Dallis, Jr.

[57] ABSTRACT

A latch with multiple locking means comprising first, second and third supporting bases for attaching to the surface of a door, gate or jamb. The latch is engaged and disengaged by pivoting a striker through interstices defined between the supporting bases and first and second stirrup members. The latch is locked from the inside by securing a padlock through a passage created by an aperture in a handle and an aperture in a first stirrup member. Additional means of locking the latch is provided by a winged unit attached to the end of the striker. The winged unit engages a double-pronged keeper and is padlocked thereto. The double-pronged keeper comprises two inclining prongs along which the striker slides. Located on an upper portion of the inclining prongs are notches in which the striker fails and is securely held. Another means for locking the latch is provided by a pin which passes through an aperture in the handle and a coninciding aperture in the first stirrup member. A pivoting assemblage and locking means are provided such that the latch is operated and locked from the outside. The latch is mounted on either the right or left side of a door or gate.

5 Claims, 4 Drawing Sheets

LATCH WITH MULTIPLE LOCKING MEANS

FIELD OF THE INVENTION

This invention relates generally to the art of latches, and most particularly, to latches which can be padlocked.

BACKGROUND OF THE INVENTION

The art of providing latches for gates and doors has been pursued for many years. As a result, a large number of patents have been granted for latches of one type or another. Most of these latches comprise a pivoting bar controlled by a lever.

One such device is disclosed in U.S. Pat. No. 1,326,554 to Watson wherein a pivotal latch is formed of a rod which is slidably positioned to lock a gate or door. U.S. Pat. No. 1,728,747 to Cheser discloses a lockable latch operated by a key.

Latches which utilize padlocks for securing a door are common in the art. One such device is disclosed in U.S. Pat. No. 2,794,663 to Grodt et al. wherein a slidable and pivotal bar includes an aperture through which a padlock is placed. Similarly, U.S. Pat. No. 3,907,344 to Newlon et al. describes a pivotal latch having eyelets through which a padlock is secured.

In U.S. Pat. No. 4,062,575 to Robins, a pivotal latch is disclosed which slides into an aperture for locking a door.

While these prior art latches perform well for their intended applications, there is no satisfactory device which provides a simple and foolproof design to lock a door or gate.

SUMMARY OF THE INVENTION

It is therefore an object of this invention to provide a latch comprising few components which are easily fitted on either the left or right side of a door or gate. It is a further object of this invention to provide a latch which may be mounted on the inside or outside of a door or gate. It is a further object of this invention to provide a latch having multiple locking means. It is a further object of this invention to provide a latch which, when locked, is impervious to dismantlement. It is a still further object to provide a latch of simple design which is inexpensively manufactured by existing procedures.

These, as well as other objects, are accomplished by a latch with multiple locking means comprising first, second and third supporting bases for attaching to the surface of a door, gate or jamb. The latch is engaged and disengaged by pivoting a striker through interstices defined between the supporting bases and first and second stirrup members. The latch is locked from the inside by securing a padlock through a passage created by an aperture in a handle and an aperture in a first stirrup member. Additional means of locking the latch is provided by a winged unit attached to the end of the striker. The winged unit engages a double-pronged keeper and is padlocked thereto. The double-pronged keeper comprises two inclining prongs along which the striker slides. Located on an upper portion of the inclining prongs are notches in which the striker falls and is securely held. Another means for locking the latch is provided by a pin which passes through an aperture in the handle and a coninciding aperture in the first stirrup member. A pivoting assemblage and locking means are provided such that the latch is operated and locked from the outside. The latch is mounted on either the right or left side of a door or gate.

BRIEF DESCRIPTION OF THE DRAWINGS

While the specification concludes with claims particularly pointing out and distinctly claiming the subject matter regarded as the invention-in light of the doctrine of equivalence, it is believed that the invention, the objects, features, and advantages thereof will be better understood from the follow description taken in connection with the accompanying drawings, in which:

DETAILED DESCRIPTION

Figure 1:
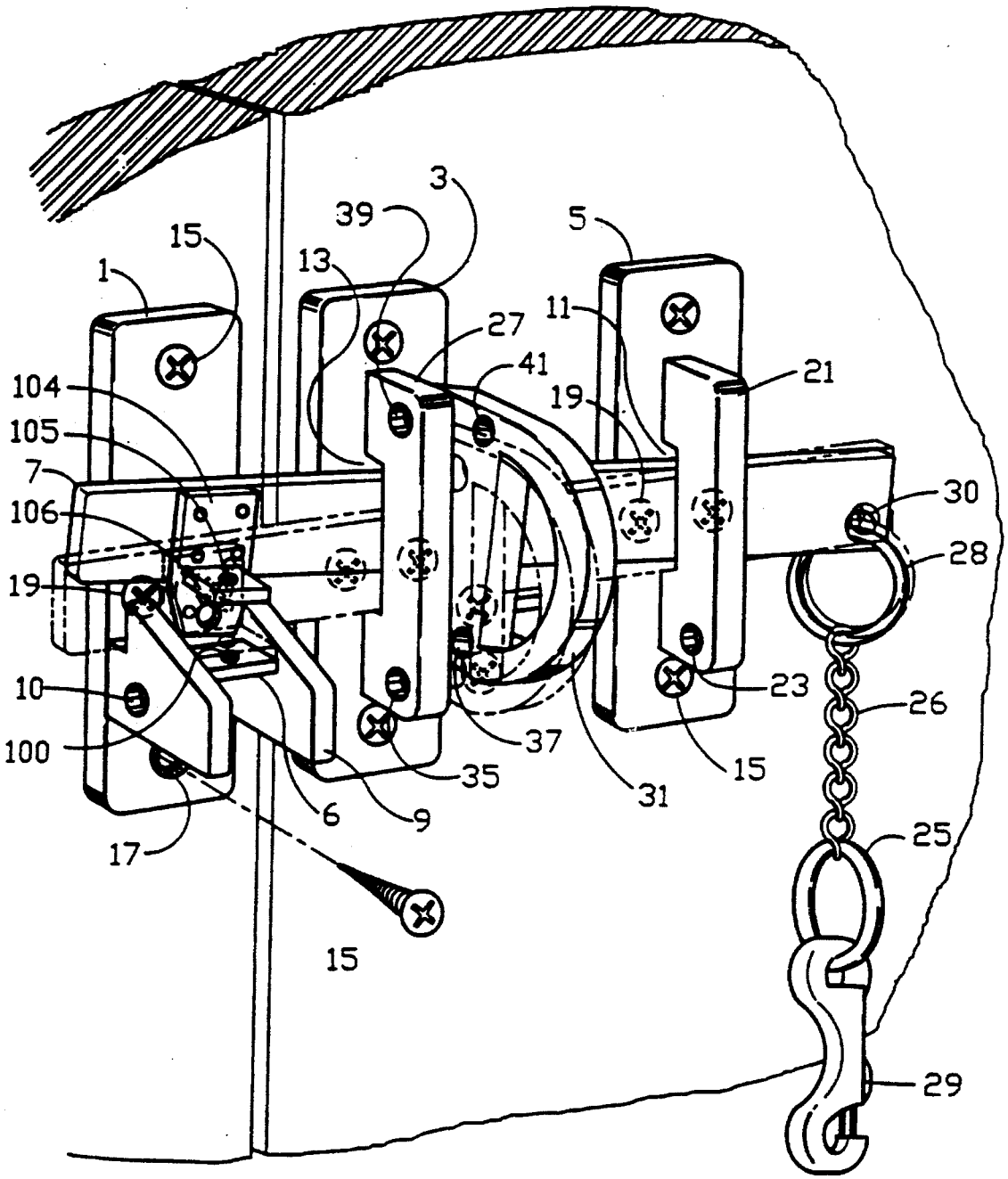
FIG. 1 of the drawings illustrates a latch in accordance with this invention.

FIG. 1 of the drawings illustrates a latch comprising first, second, and third supporting bases 1, 3, and 5 respectively, a striker 7, and a double-pronged keeper 9 having a first and second prongs 9*a* and 9*b*, respectively. Base 1 is attached to a jamb while bases 3 and 5 are affixed to a door or gate. Or, bases 5 and 3 are attached to a jamb while base 1 is attached to a door or gate. Other combinations are possible, making this latch extremely versatile. The latch is positioned on the left or right side of a door or gate, or on the inside or outside surface thereof. Additionally, the latch is locked from either side of a door or gate.

Striker 7 locks and unlocks the latch by a tilting movement through interstices 11 and 13. Supporting bases 1, 3, and 5 are secured to a door, gate, or jamb by screws 15 which pass through holes 17. Additional securance is provided by screws 19 which pass through holes spaced horizontally, side by side, toward the mid-portions of each supporting base. FIG. 1 illustrates two holes in the mid-portions of each supporting base, but it is noted that any number of holes are utilized. For example, each supporting base may include two rows of two holes wherein one row of holes is disposed above the other and wherein the holes are spaced horizontally, side by side, toward the mid-portions of each supporting base.

First stirrup 21, defining a generally U-shape, is attached to base 3 by spot welding or by any number of means heretofore utilized. Mounted to base 5 is second stirrup 27 therebetween being defined interstice 13 wherein striker 7 moves. Aperture 23, in which a padlock is stored, is located in the bottom portion of second stirrup 27.

As illustrated, interstice 11 is of greater dimension than interstice 13. The difference in height allows the tilting action of striker 7 such that it can be removed from the captivity of double-pronged keeper 9. The latch, in accordance with this invention, is operable by handle 31 comprising a D-shaped extension having the linear side thereof attached by welding or any means heretofore utilized to the mid-portion of striker 7. The linear side of handle 31 includes through each end thereof a bottom aperture 37 and a top aperture 41. Striker 7 is held in a horizontal position by double-pronged keeper 9, and in this posture, covers screws 19. Handle 31 allows the user to pivot striker 7 from the captivity of double-pronged keeper 9. When the latch is engaged, handle 31 abuts first stirrup 21 such that aperture 35 aligns with aperture 37 to form a passage through which a padlock is secured if it is desired the latch be permanently locked. A padlock is also secured through apertures 37 and 23, keeping the latch in a permanently unlocked position. It is noted that when permanently locked, the latch becomes impervious to dismantlement as lateral and vertical movement of striker 7 is prohibited and, therefore, accessibility to screws 19. Striker 7 covers screws 19, thereby making the latch burglar-proof even though screws 15 are removed. A padlock is stored in aperture 10 located through first prong 9*a*.

Double-pronged keeper 9 holds striker 7 such that doors will be held tightly closed, and this is particularly beneficial when the latch is attached to double hung doors which swing. The double-pronged keeper will prevent doors from swinging, a problem associated with latches utilizing single keepers. Additionally, first prong 9*a* and second prong 9*b* incline from the front portions thereof toward first supporting base 1 such that striker 7 is slidable along inclined portions 12. The sliding motion along inclined portions 12 raise striker 7 such that it falls into notches 14 defined in the upper portions of first prong 9*a* and second prong 9*b*.

Figures 2, 2A:
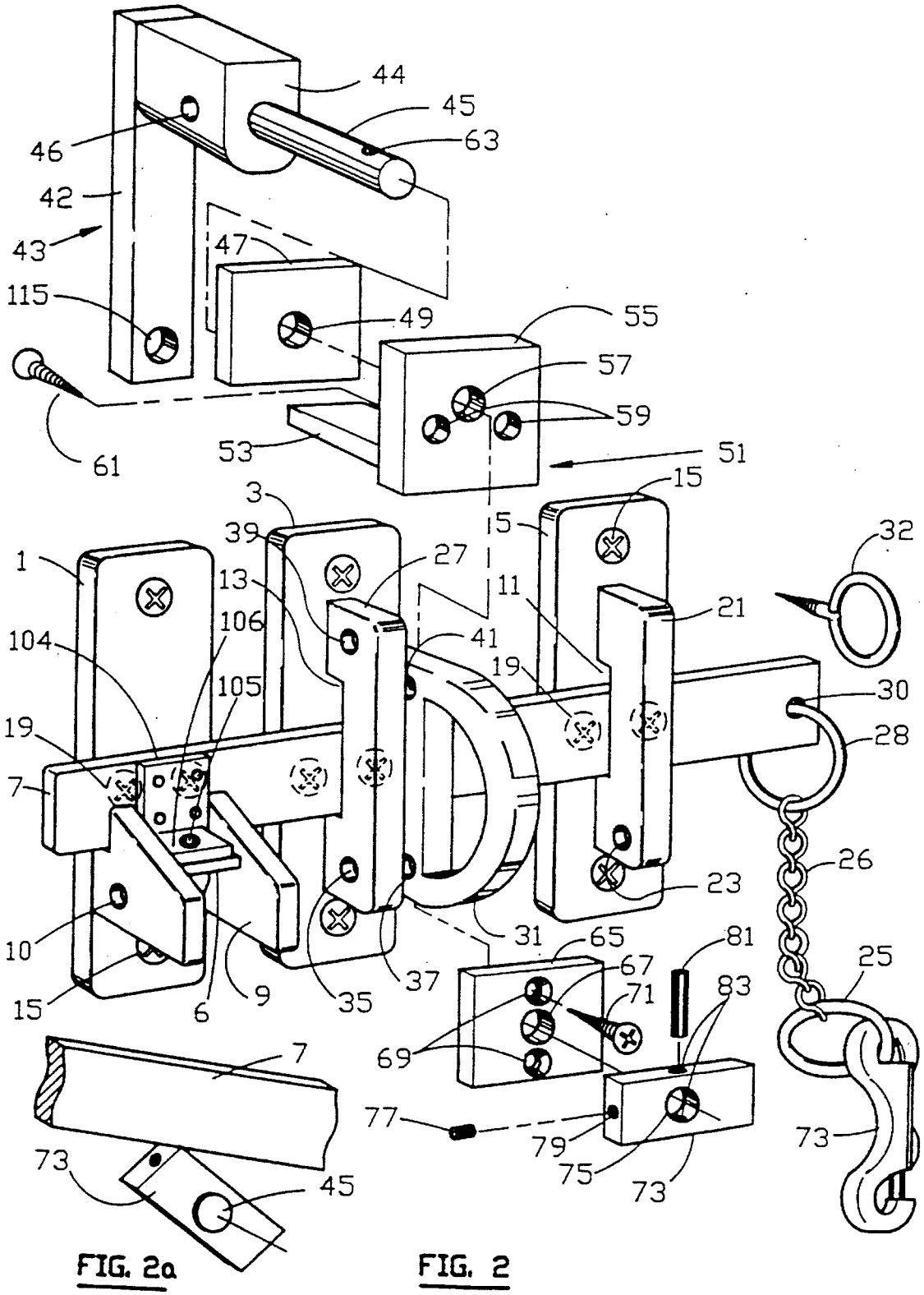
FIG. 2 of the drawings illustrates an assemblage for pivoting the striker with a locking means incorporated in the pivoting assemblage.
FIG. 2*a* of the drawings illustrates a winged unit tilting the striker.

As illustrated in FIG. 2, the latch is operated by an assemblage which pivots striker 7. Handle 43 comprises a bottom plate 42 of a substantially rectangular shape attached to a top leg 44 which is squarely shaped at the top portion thereof and rounded at the bottom portion thereof such that top leg 44 forms a substantially U-shape. Bottom plate 42 and top leg 44 are perpendicularly attached such that handle 43 forms a substantially L-shape. Top leg 44 is of such dimension to fixedly hold therein one end of axle 45. For storing a padlock, hole 115 is provided through the tip end of handle 43.

Cover 47 includes aperture 49 through which axle 45 is rotatably positioned. Cover 47 also prevents accessibility to screws 61, making the latch impervious to dismantlement. Cover 47 is juxtaposed to brace 51. Brace 51 comprises a bottom leg 53 and an upright leg 55 which are perpendicular to one another, thus forming a roughly L-shape. Bottom leg 53 is generally the same width as top leg 44. Upright leg 55 includes a central aperture 57 and two secondary holes 59. Central aperture 57 communicates with aperture 49 such that axle 45 is rotatably positioned through both apertures 49 and 57. When axle 45 is positioned through apertures 49 and 57, the bottom of top leg 44 rests upon the top of bottom leg 53. Because the bottom of top leg 44 is substantially U-shaped, top leg 44 rolls upon the top of bottom leg 53 when handle 43 is turned. Secondary holes 59 are disposed on each side of the central aperture 57 and are of sufficient diameter for insertion of screws 61 for attaching brace 51 to the inside surface of a door or gate.

The user will cut axle 45 to the desired length and aperture 63 is drilled through the end thereof, allowing axle 45 to be customized to the thickness of the door or gate through which it will pass. Of course, a passage for the axle must be drilled through the door, such passage allowing the axle to rotate therein. Spacer 65 includes three apertures spaced vertically, one on top of another. Central aperture 67 is aligned to apertures 49 and 57. The passage drilled through the door or gate allows apertures 57 and 67 to communicate, and axle 45 is rotatably positioned through apertures 49, 57 and 67. Secondary apertures 69 are disposed on the top and bottom of central aperture 67 and are of sufficient diameter for insertion of screws 71 for attaching spacer 65 to the surface of a door or gate.

Means for lifting striker 7 from the captivity of double-pronged keeper 9 comprises wing 73 disposed adjacently underneath striker 7, as illustrated in FIG. 2a. Aperture 75 communicates with aperture 67 such that the end of axle 45 passes through both apertures 67 and 75. Set screw 77, when engaged in aperture 79, fixedly positions axle 45 inside aperture 75. The rotation of axle 45 tilts wing 73 which, in turn, lifts striker 7 from double-pronged keeper 9. By passing through aperture 63 on the end of axle 45, pin 81, when inserted through apertures 83, also fixedly secures axle 45 inside aperture 75.

To engage and disengage the latch, the user simply turns handle 43 to the right or left. Top leg 44 pivots on bottom leg 53 as axle 45 rotates, tilting wing 73 which lifts striker 7. A padlock is secured through hole 46 and around bottom leg 53 if it is desired the latch be permanently locked. With the padlock in this position, bottom leg 53 catches the padlock and prevents handle 43 from turning.

Figure 3:
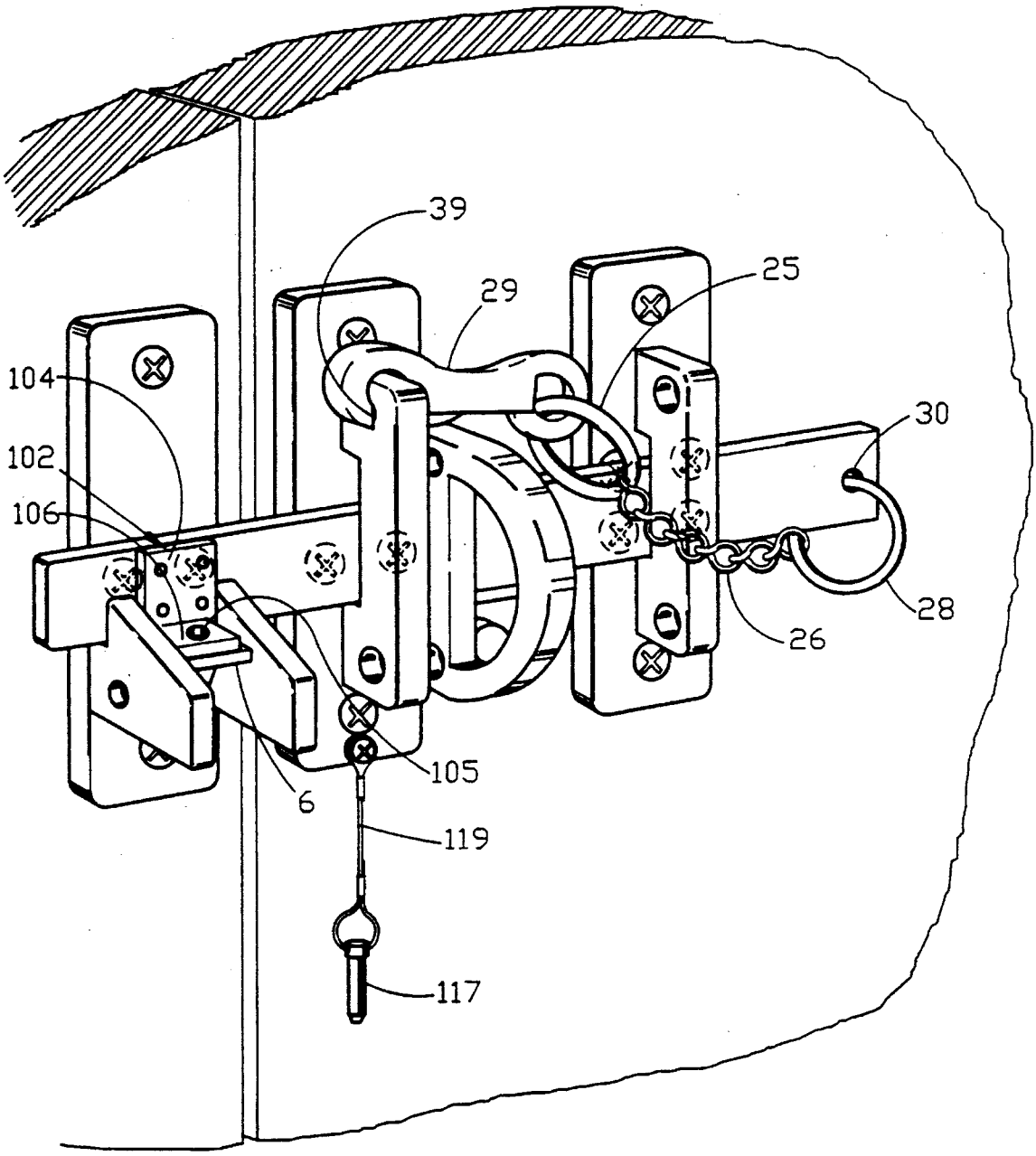
FIG. 3 of the drawings illustrates the latch engaged by a clasp means as well as a pin for preventing an upward tilt of the striker.

As illustrated in FIG. 3, attached to the end of striker 7 is clasp means 29. Clasp means 29 is attached to ring 25 which is attached to chain 26 which is attached to ring 28 which is engaged in aperture 30 located through the end of striker 7. Clasp means 29 is engaged through aperture 39 such that chain 26 prevents the sliding of striker 7. When a door or gate is opened or closed over a period of time, striker 7 could move to the extent that it would not properly engage double-pronged keeper 9. Clasp means 29 is engaged in ring 32 which is screwed into an adjacent wall or jamb such that the door is kept open and held in that position by chain 26. It is noted that clasp means 29 is secured to a fence, or any other object, for keeping open the door or gate. Ring 32 is used only when there is no object to which clasp means 29 may be attached. Additionally to prevent the upward tilting of striker 7, clasp means 29 is engaged through apertures 35 and 37. Or pin 117, attached to cable 119, is inserted through apertures 35 and 37 to prevent the striker from tilting upward. Pin 117 includes aperture 118 through which clasp means 29 engages for preventing upward movement of striker 7. A padlock may also be placed through aperture 118 for permanently locking the latch.

Figure 4:
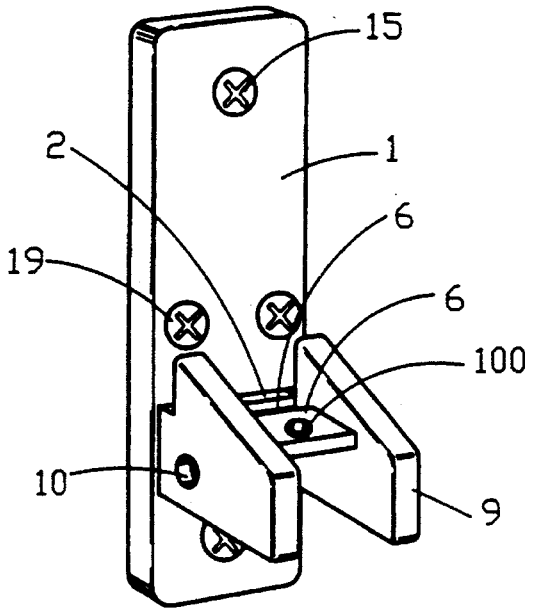
FIG. 4 of the drawings illustrates a double-pronged keeper.
Figure 5:
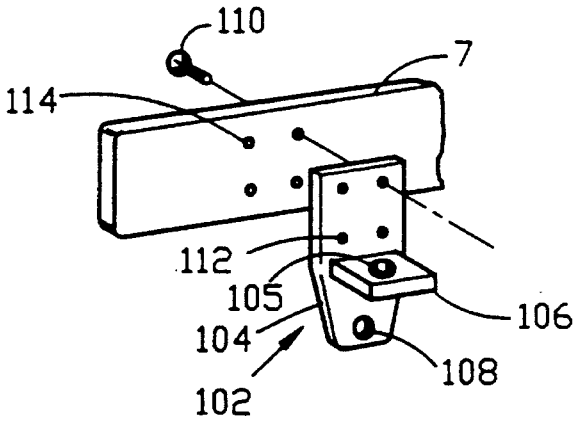
FIG. 5 of the drawings illustrates a locking means attachable to the striker.

The invention includes an additional means for locking the latch. FIG. 4 illustrates double-pronged keeper 9 attached to base 1 and comprising first prong 9*a* and second prong 9*b*. Plate 2, comprising a thin strip of steel or similar material, is attached between first prong 9*a* and second prong 9*b* such that striker 7 will rest upon the front edge of plate 2. The rear side of plate 2 is attached to base 1 by welding or similar means, and both ends of plate 2 are attached to the inside portions of the first prong 9*a* and second prong 9*b*. Plate 6 is attached between first prong 9*a* and second prong 9*b* such that interstice 8 is formed between plate 2 and plate 6 and such that both plates lie in the same horizontal plane. Aperture 100 is centrally disposed through plate 6. FIG. 5 illustrates winged unit 102 comprising a base 104 and leg 106. Base 104 and leg 106 form a substantially T-shape. The top portion of base 104 is squarely shaped and the bottom portion of base 104 is polygonal, comprising a three sides, wherein two diagonal outer sides are connected by a horizontal tip such that a generally V-shape is formed. Leg 106 includes an aperture 105 centrally disposed therethrough, and base 104 includes an aperture 108 located towards the horizontal tip thereof. Winged unit 102 is attached towards the end of striker 7. Base 104 includes two rows of two apertures 112 wherein each aperture is spaced horizontally, side by side, and which communicate with coinciding apertures 114 disposed through striker 7. From the backside of striker 7, screws 110 are engaged into apertures 114 and apertures 112 such that winged unit 102 is secured to striker 7 such that leg 106 is perpendicular to the bottom edge of striker 7. It is noted that the ends of screws 110 are flush with the surface of winged unit 102 and do not protrude through apertures 114, thus further making the latch impervious to dismantlement. The bases of screws 110 are flush with the backside of striker 7. Alternatively, the winged unit may be welded to the striker.

Figure 6:
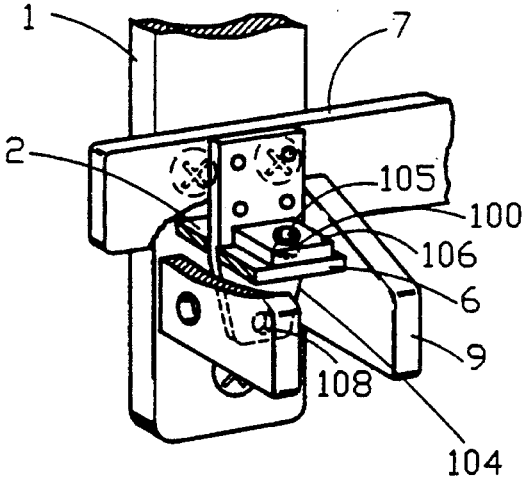
FIG. 6 of the drawings illustrates the locking means engaged by the double-pronged keeper.

As illustrated in FIG. 6, when used with double-pronged keeper 9, the bottom portion of base 104 will fall into interstice 8 thereby locking the latch and therefore the doors to which the latch is attached. Leg 106 falls onto plate 6 such that aperture 105 communicates with aperture 100 to form a passage through which a padlock is placed for permanently locking the latch. Additionally, the latch is permanently locked by placing a padlock through aperture 108. Since the width of the padlock would be greater than the width of interstice 8, striker 7 is prevented from pivoting upwards and away from the captivity from double-pronged keeper 9.

As various modifications occur to those familiar with the art, such modifications may occur without departing in any way from the spirit and scope of the following appended claims.

That which is claimed is:

1. A latch with multiple locking means for attaching to a door or gate, said latch comprising:

a. first, second and third supporting bases for attaching to the surface of a door, gate or jamb, said supporting bases being substantially rectangular in shape such that the vertical dimension of each supporting base is larger than the horizontal dimension of the same, there being defined in each said supporting base a number of holes for insertion of screws or bolts therethrough, such holes being located, one toward the top end, one toward the bottom end, and at least two toward the center, spaced horizontally side by side;

b. a striker comprising an elongate bar rectangular in shape and having first and second ends, said striker in a horizontal position covering the holes located toward the center of said first, second and third supporting bases, said striker having through the first end thereof four holes spaced in two rows wherein each row includes two holes spaced horizontally and side by side, said holes being in the same horizontal, vertical and diagonal planes, said striker including an aperture centrally disposed in the second end thereof, c. a double-pronged keeper defining first and second prongs spatially mounted, side by side, on the lower portion of said first supporting base, said prongs inclining from the front portions thereof toward said first supporting base such that said striker is slidable along said incline, said prongs including on the upper sides thereof a notch adjacent to said first supporting base such that said striker falls into and is securely held by said notches, said first prong including in the rear portion thereof an aperture in which a padlock is stored, said double-pronged keeper further including:

(1) a rear plate having a top edge, a bottom edge, two vertical ends, a front, and a back, attached between said first and second prongs such that said striker will rest upon the top edge of said rear plate, the back of said rear plate being attached to said first supporting base, and the two vertical ends of said rear plate being attached to inside portions of said first and second prongs;

(2) a forward plate having a top, a bottom, a front edge, a rear edge, and a first and a second end attached between said first and second prongs such that a gap is formed between the front edge of said rear plate and the rear edge of said forward plate and such that said forward plate is horizontal and the top of said forward plate lies in the same horizontal and the top of said forward plate lies in the same horizontal plane as the top edge of said rear plate, said forward plate including an aperture disposed through the center portion thereof;

d. a first stirrup defining a generally U-shape and including an aperture defined in top and bottom portions thereof, said first stirrup mounted on said second supporting base such that an interstice is formed therebetween in which said striker pivots;

e. a second stirrup defining a generally U-shape and including an aperture in a bottom portion thereof, said second stirrup mounted on said third supporting base such that an interstice is formed therebetween in which said striker pivots;

f. a handle for opening and closing the latch by pivoting said striker, having a vertical member and a U-shaped member which are joined to form a substantially D-shape and including apertures defined in the top and bottom portions of the vertical member such that the aperture in the bottom portion of the vertical member communicates with the aperture in the bottom portion of said first stirrup such that a passage is formed through which a padlock may be placed, said aperture in the bottom portion of the vertical member communicating also with the aperture in the bottom portion of said second stirrup such that a passage is formed through which a padlock may also be placed.

g. clasp means for prohibiting said striker from sliding and pivoting upward, said clasp means engaging the aperture in the top portion of said first stirrup;

h. a chain connecting said clasp means to said striker, said chain including on each end thereof a circular band wherein one said circular band is engaged through the aperture centrally disposed through the second end of said striker and the other said circular band is connected to said clasp means, said chain being of such length as to prohibit said striker from sliding when said clasp means is engaged in the aperture in the top portion of said first stirrup;

i. a ring around which said clasp means is affixed for keeping open a door or gate, said ring screwable into the exterior of an adjacent wall or other surface;

j. a pivoting assemblage for opening and closing the latch by tilting said striker, said assemblage operable from the side of the door opposite the side to which said bases are mounted.

k. an additional means for padlocking said latch.

2. A latch as recited in claim 1 wherein the holes located toward the center of each said supporting base number two such that said striker in a horizontal position covers said holes.

3. A latch as recited in claim 1 which further comprises a pin for preventing upward pivoting of said striker, said pin attached by a flexible cable to the bottom end of said second supporting base and simultaneously engaging the aperture in the bottom portion of the linear arm of said handle and the aperture in the bottom portion of said first stirrup, said pin including an aperture through the tip portion thereof for insertion of said clasp means or a padlock for preventing upward movement of said striker.

4. A latch as recited in claim 1 wherein said pivoting assemblage comprises:

a. an outside handle for tilting said striker, said outside handle comprising an elongate plate substantially rectangular in shape attached to a horizontal leg such that a substantially L-shape is formed, said horizontal leg comprising a squarely shaped top portion and a rounded bottom portion such that a generally U-shape is defined, said horizontal leg having through the center portion thereof an aperture, said elongate plate including an aperture in the tip end thereof for storing a padlock;

b. an axle having a first end fixedly attached inside said horizontal leg, said axle being of such length to be cut to accommodate various thicknesses of doors and gates, said axle having a second end through which is drilled an aperture;

c. a cover, substantially squarely-shaped, having an aperture through the center portion thereof;

d. brace for attaching to the surface of a door or gate, said brace comprising a bottom leg, substantially rectangular-shaped, attached to a top leg generally squarely-shaped such that said legs form a substantially L-shape, said top leg having a central aperture through the center portion thereof and two secondary holes through which screws pass for mounting said brace to the surface of a door or gate, said secondary holes spaced horizontally, side by side, towards opposite corners of said top leg and located below said central aperture such that said cover conceals the screws which pass through said secondary holes, said top leg juxtaposed to said cover such that the central aperture in said top leg communicates with the central aperture in said cover such that said axle is rotatably positioned through both said central apertures, and such that when said axle is positioned through said central apertures, the bottom of the horizontal leg of said handle rests upon the top of the bottom leg of said brace, said bottom leg and said horizontal leg being of substantially the same width and length such that a padlock is placed in the aperture through said horizontal leg and wraps around said bottom leg for keeping stationary said outside handle for preventing said latch from being opened by said outside handle;

e. a spacer, generally squarely-shaped, having through the center portion thereof a central aperture and two secondary apertures, said secondary apertures allowing screws to pass therethrough for mounting said spacer to the surface of a door or gate opposite said brace, said apertures spaced vertically, one above another such that said central aperture is located between said secondary apertures, said central aperture communicating with the central aperture in said brace and the central aperture in said cover such that said axle is rotatably positioned through the central apertures in said cover, said brace and said spacer;

f. a tab for tilting said striker away from the captivity of said double-pronged keeper, said tab substantially rectangular-shaped having through the center portion thereof a central aperture in which is engaged the tip end of said axle, said tab having through one side portion thereof a threaded aperture through which a set screw passes for fixedly holding said axle inside the central aperture of said tab, said tab having through a top portion thereof an aperture extending through an interior portion of said tab such that a pin passes therethrough for engaging the aperture drilled in the end of said axle thereby fixedly holding said axle inside the central aperture in said tab, said tab abutting and moveable about said spacer such that when said axle turns to the right or left said tab rotates and pushes said striker upwards and away from said double-pronged keeper.

5. A latch as recited in claim 1 wherein said additional means for padlocking said latch comprises, a. a winged unit for engaging said double-pronged keeper, said winged unit defining a substantially T-shape and further comprising, (1) a base having a top portion which is substantially squarely shaped and a polygonal portion comprising three sides wherein two diagonal outer sides are connected by a horizontal tip such that a generally V-shape is formed, said polygonal portion including an aperture located towards the horizontal tip thereof for allowing a padlock to be placed therethrough, said top portion having four holes spaced in two rows wherein each row includes two holes spaced horizontally and side by side, said holes being in the same horizontal, vertical and diagonal planes and communicating with the four holes disposed through the first end of said striker such that screws or similar fasteners are inserted into the four holes located through the first end of said striker from the backside thereof such that the screws engage the four holes in the top portion of said base for fixedly holding said winged unit to the first end of said striker, said polygonal portion, when said striker engages said double-pronged keeper, penetrating said gap formed by said rear plate and said forward plate;

(2) a protruding leg perpendicularly attached to the mid-portion of said base such that said protruding leg is generally perpendicular to the bottom edge of said striker, said protruding leg, when said striker engages said double-pronged keeper, falling flatly upon said forward plate such that an aperture centrally disposed through said protruding leg communicates with the aperture defined through the center portion of said forward plate such that a passage is formed through which a padlock is secured.

* * * * *